US009833724B2

(12) United States Patent
Chin

(10) Patent No.: US 9,833,724 B2
(45) Date of Patent: Dec. 5, 2017

(54) DETACHABLE AXLE

(71) Applicant: T. K. Chin Company Ltd., Taipei (TW)

(72) Inventor: Howard Chin, Taipei (TW)

(73) Assignee: T. K. Chin Company Ltd., Taipei (TW)

( * ) Notice: Subject to any disclaimer, the term of this patent is extended or adjusted under 35 U.S.C. 154(b) by 5 days.

(21) Appl. No.: 15/050,970

(22) Filed: Feb. 23, 2016

(65) Prior Publication Data

US 2017/0189827 A1 Jul. 6, 2017

(30) Foreign Application Priority Data

Jan. 6, 2016 (TW) ..... 105100273 A

(51) Int. Cl.

| | |
|---|---|
| ***A63H 17/00*** | (2006.01) |
| ***A63H 33/04*** | (2006.01) |
| ***A63H 17/26*** | (2006.01) |
| ***A63H 33/08*** | (2006.01) |

(52) U.S. Cl.

CPC ..... *A63H 33/042* (2013.01); *A63H 17/002* (2013.01); *A63H 17/262* (2013.01); *A63H 33/08* (2013.01)

(58) Field of Classification Search

USPC ..... 446/93–96, 465, 469, 470

See application file for complete search history.

(56) References Cited

U.S. PATENT DOCUMENTS

| | | | | | |
|---|---|---|---|---|---|
| 2,940,211 | A * | 6/1960 | Kelley | A63H 33/084 | 446/124 |
| 3,224,137 | A * | 12/1965 | Wright | A63H 33/08 | 446/124 |
| 3,540,151 | A * | 11/1970 | Ishida | A63H 17/00 | 446/121 |
| 3,611,618 | A * | 10/1971 | Steiner | A63H 17/002 | 446/95 |
| 3,939,600 | A * | 2/1976 | Eid | A63H 33/12 | 446/94 |
| 4,690,656 | A * | 9/1987 | Friedman | A63H 17/262 | 446/424 |
| 5,120,254 | A * | 6/1992 | Daniels | A63H 17/262 | 446/466 |

(Continued)

*Primary Examiner* — Kurt Fernstrom

(74) *Attorney, Agent, or Firm* — C. G. Mersereau; Nikolai & Mersereau, P.A.

(57) ABSTRACT

A detachable axle comprises an axial body, two engaging portions, and two pivoting portions. The two engaging portions are respectively formed on two axial ends of the axial body, each of the engaging portions has an engaging groove, and the engaging groove is radially formed on the engaging portion. The two pivoting portions are respectively formed on the two engaging portions and extend outwards from the engaging portions. In use, the detachable axle is engaged with a general building block by the two engaging portions. The two pivoting portions extend out of the two sides of the building block and wheels are mounted around the two pivoting portions, so the building block has a moving function. The axial body and the building block could be separated to make the building block become the general combining type. The versatility of the general building block is expanded without any limitation.

12 Claims, 9 Drawing Sheets

(56) References Cited

U.S. PATENT DOCUMENTS

| | | | | |
|---|---|---|---|---|
| 5,259,808 | A * | 11/1993 | Garr | A63H 17/004 446/437 |
| 6,443,797 | B1 * | 9/2002 | Liu | A63H 17/002 229/103 |
| 6,616,500 | B1 * | 9/2003 | Harms | A63H 18/02 446/128 |
| 7,922,556 | B2 * | 4/2011 | Schreff | A63H 33/088 273/156 |
| 8,534,394 | B2 * | 9/2013 | Lin | H02S 40/38 180/2.2 |
| 2007/0238390 | A1 * | 10/2007 | Kelderhouse | A63H 17/262 446/469 |

* cited by examiner

DETACHABLE AXLE

CROSS-REFERENCE TO RELATED APPLICATIONS

This application is based upon and claims priority under 35 U.S.C. 119 from Taiwan Patent Application No. 105100273 filed on Jan. 6, 2016, which is hereby specifically incorporated herein by this reference thereto.

BACKGROUND OF THE INVENTION

1. Field of the Invention

The invention relates to a detachable axle that is connected to wheels and a building block to provide the building block with a moving function.

2. Description of the Prior Arts

A building block is a kind of toy to train imagination and creativity of human beings. The building block includes various types and has no standard way of combination. Therefore, various types of building blocks are assembled to form all kinds of objects. An axle building block has been developed for more types of combination of the building blocks. A wheel is mounted around an axle of the axle building block. A model combined with the axle of the axle building block is able to move on the ground. However, the axle is formed on an outer surface of the axle building block. When the axle building block is not connected to a wheel, the axle building block is unsuitable to use as a general building block due to the protruding axle. Therefore the versatility of the axle building block is limited and needs to be improved.

To overcome the shortcomings, the present invention provides a detachable axle to mitigate or obviate the aforementioned problems.

SUMMARY OF THE INVENTION

Because the conventional axle building block is limited in ways of combination, the present invention provides a detachable axle to connect a general building block to provide the general building block with a moving function and to eliminate the combining limitation in the general building block.

To achieve the aforementioned objective, a detachable axle in accordance with the present invention comprises an axial body, two engaging portions, and two pivoting portions. The two engaging portions are respectively formed on two axial ends of the axial body, each of the two engaging portions has an engaging groove, and the engaging groove is radially formed on the engaging portion. The two pivoting portions are respectively formed on the two engaging portions and axially extend outwards from the engaging portions. Each of the two pivoting portions is cylindrical.

In use, a detachable axle is fastened with a general building block by the two engaging portions. The two pivoting portions extend out of the two sides of the building block, and two wheels are mounted around the two pivoting portions, so the building blocks have a moving function. Because the axle is detachable, the axial body and the building block could be separated. For the reason, the versatility of the general building block is expanded without any limitation.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
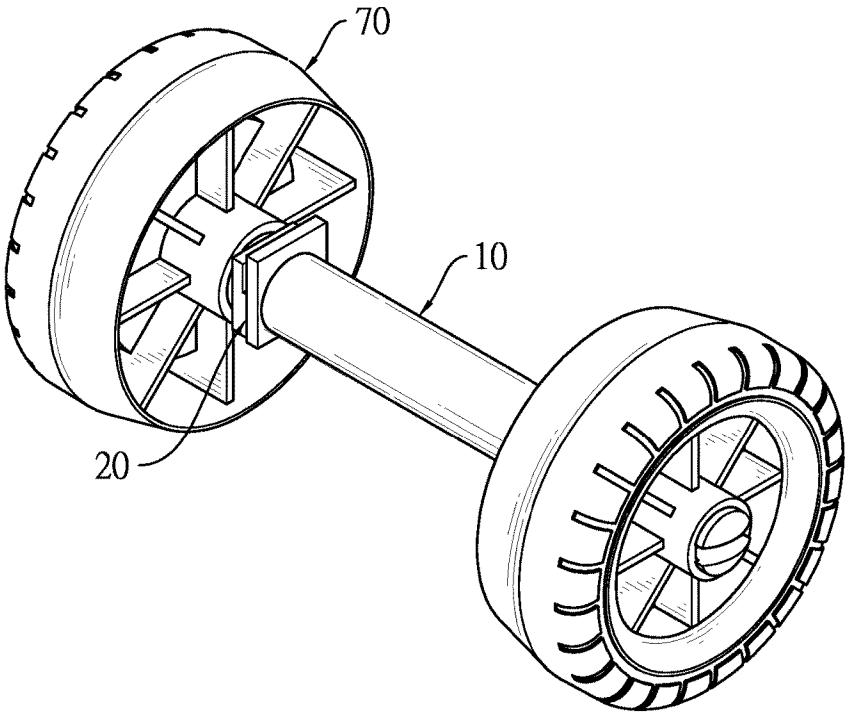
FIG. 1 is a perspective view of a first embodiment of a detachable axle in accordance with the present invention.
Figure 2:
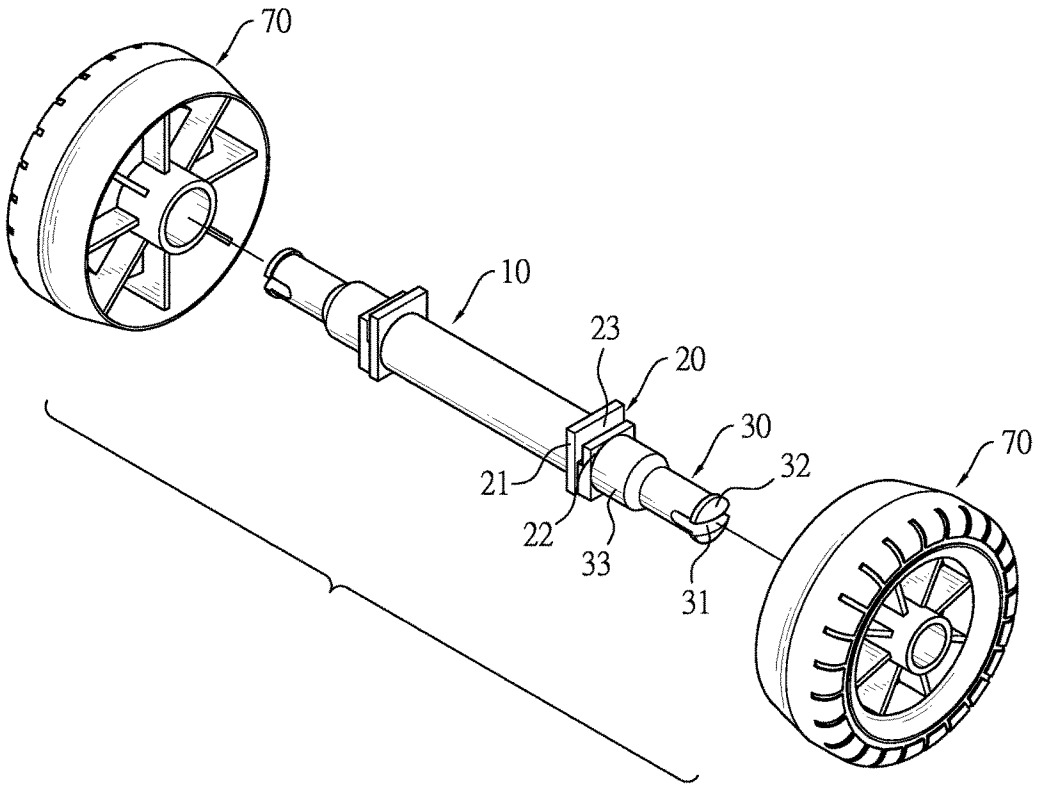
FIG. 2 is an exploded view of the first embodiment of the detachable axle in FIG. 1.
Figure 3:
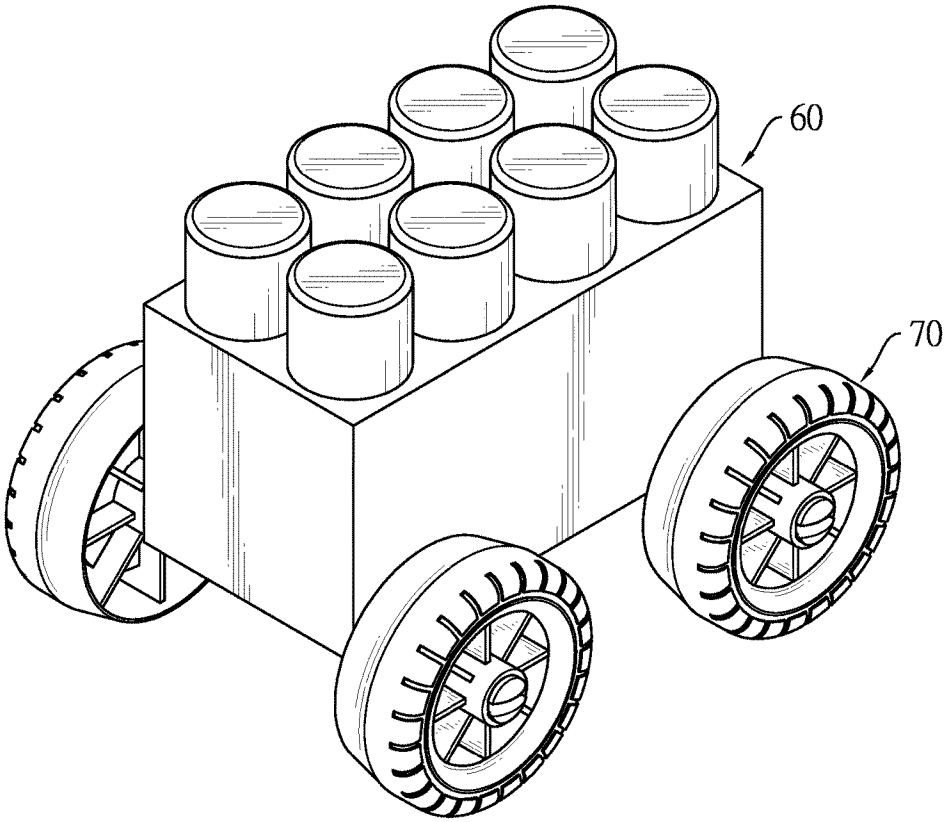
FIG. 3 is a perspective view of the detachable axle combined with a building block in FIG. 1.

With reference to FIGS. 1 to 3, a first embodiment of a detachable axle in accordance with the present invention has an axial body 10, two engaging portions 20, and two pivoting portions 30.

With reference to FIGS. 1 and 2, the axial body 10 is cylindrical, and in another embodiment, the axial body is rectangular or in any other shape.

Figure 4:
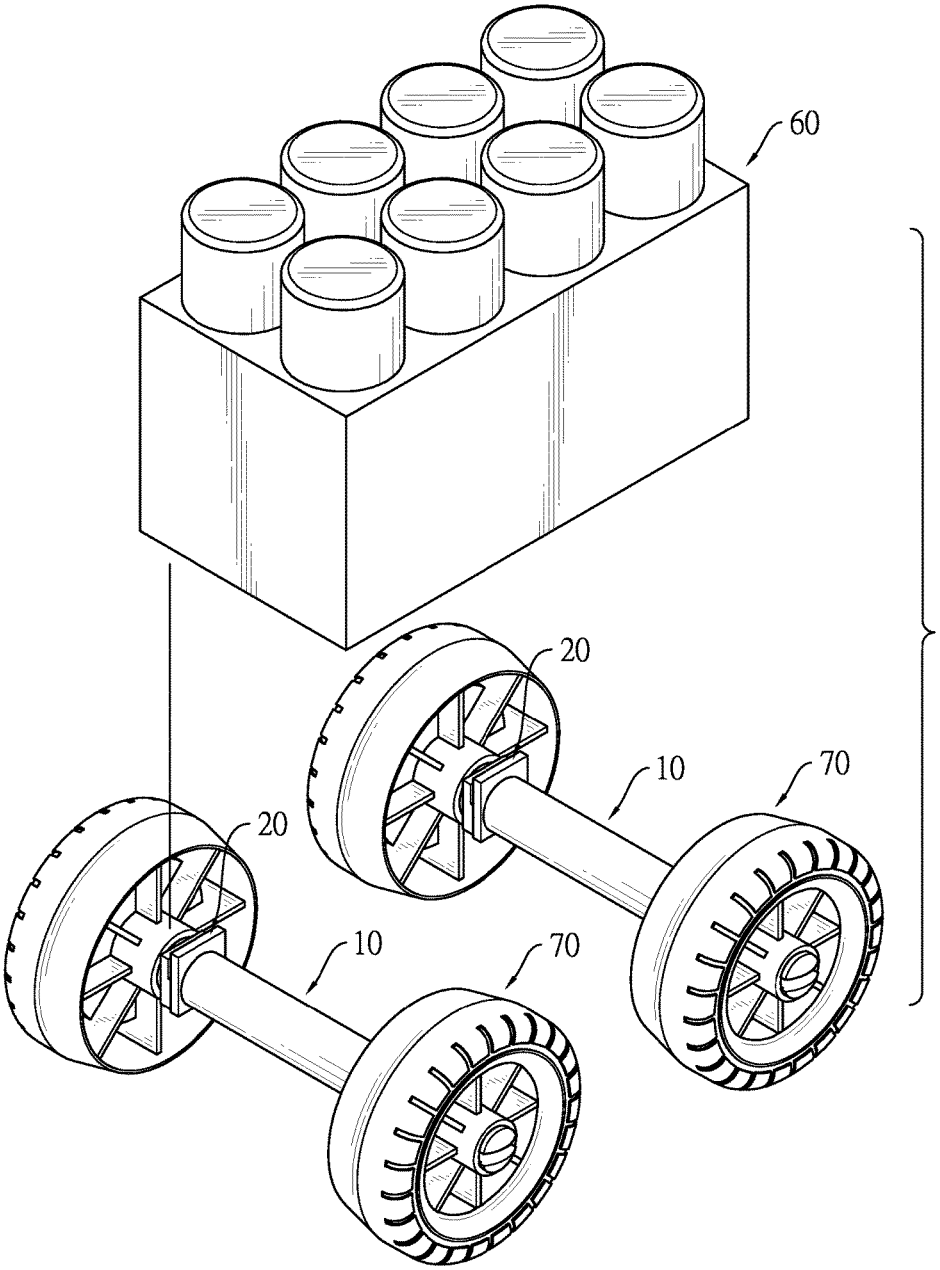
FIG. 4 is an exploded view of the detachable axle with the building block in FIG. 3.
Figure 5:
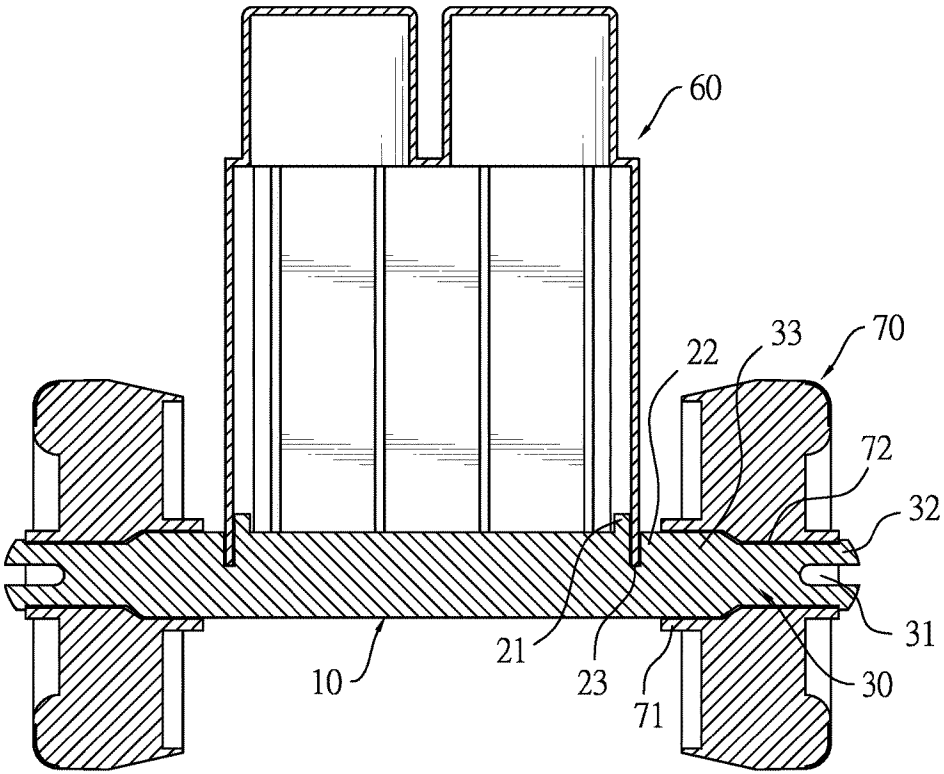
FIG. 5 is a cross-sectional side view of the detachable axle combined with the building block in FIG. 3.
Figure 6:
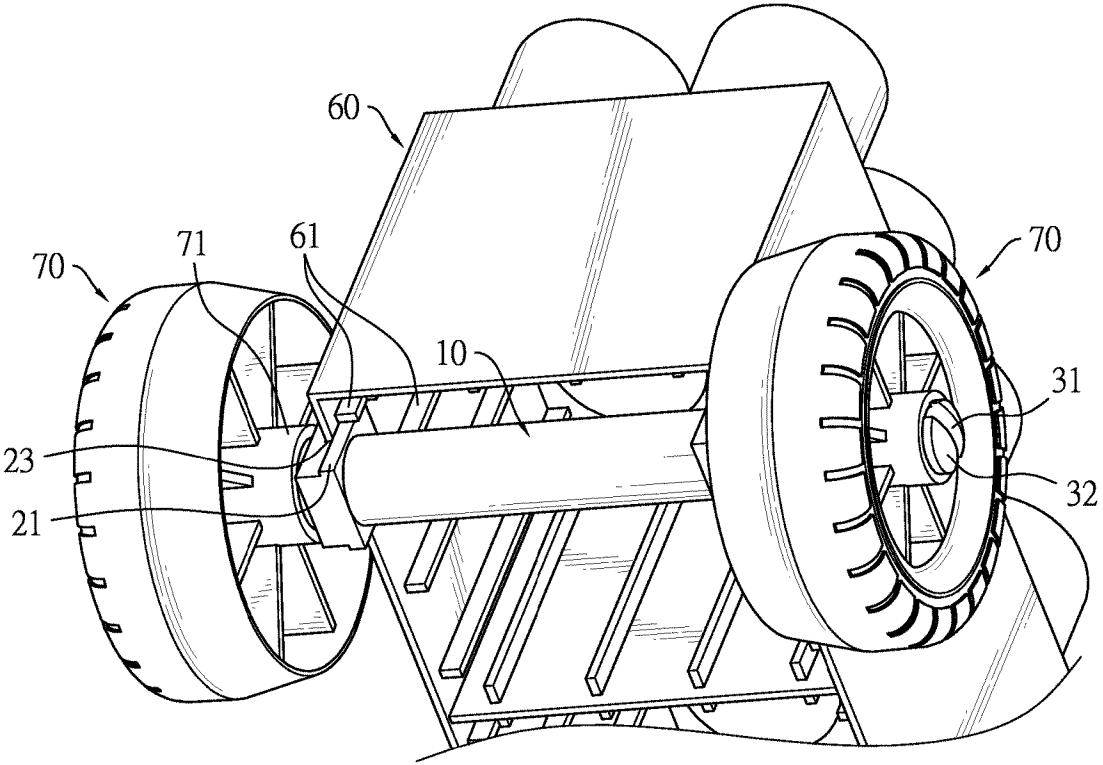
FIG. 6 is a partial view of the detachable axle engaged with the building block in FIG. 3.

With reference to FIGS. 2, 4 and 5, the two engaging portions 20 are respectively formed on two axial ends of the axial body 10, and each of the two engaging portions 20 has a first abutting plate 21, a second abutting plate 22, and an engaging groove 23. The first abutting plate 21 is connected to the axial body 10 and radially extends outwards from the axial body 10. The second abutting plate 22 is connected to the axial body 10 and radially extends outwards from the axial body 10. The engaging groove 23 is radially formed between the first abutting plate 21 and the second abutting plate 22 of the engaging portion 20. A radial extending length of the first abutting plate 21 is longer than a radial extending length of the second abutting plate 22. In another embodiment, each of the two engaging portions 20 only has two engaging grooves 23 without having any abutting plate. The radial extending length of the first abutting plate 21 is shorter than the radial extending length of the second abutting plate 22, or the radial extending length of the first abutting plate 21 is equal to the radial extending length of the second abutting plate 22. These various embodiments achieve the same effect.

With reference to FIGS. 2 and 3, the two pivoting portions 30 are respectively formed on the two engaging portions 20 and extend outwards along the axial direction of the axial body 10. Each of the two pivoting portions 30 is cylindrical and has a compression groove 31, two limiting blocks 32, and an obstructing block 33. The compression groove 31 is axially formed on an end of the engaging portion 30. The two limiting blocks 32 are formed on two opposite outer surfaces around two ends of the pivoting portion 30. The obstructing block 33 is formed around the pivoting portion 30 and is mounted at axial intervals with the two limiting blocks 32. The obstructing block 33 is higher than the outer surface of the pivoting portion 30 to form a height difference.

With reference to FIGS. 2, and 4 to 6, in use, multiple detachable axles are engaged with two opposite walls of a general building block 60 by the engaging grooves 23 of the two engaging portions. The two opposite walls of the building block 60 are respectively fastened by one first abutting plate 21 and one second abutting plate 22, and the first abutting plate 21 of each engaging portion 20 is held by two spacing protruding ribs 61 of the building block 60 to avoid the relative sliding between the detachable axle and the building block 60 to strengthen the stability. The height difference of the first abutting plate 21 and the second abutting plate 22 is used to locate and fasten the building block 60 with the detachable axle. The two pivoting portions 30 respectively extend out of the building block 60, and two wheels 70 are mounted around the two pivoting portions 30, so the building blocks 60 could have a moving function. The wheel 70 has a first channel 71 and a second channel 72. An inner diameter of the first channel 71 is longer than an inner diameter of the second channel 72. One wheel 70 is mounted around the corresponding pivoting portion 30 of the detachable axle and the first channel 71 is mounted towards the building block 60, finally the first channel 71 of the wheel 70 is disposed around the obstructing block 33, and the second channel 72 is disposed around the pivoting portion 30 and is limited between the two limiting blocks 32 and the obstructing block 33 to avoid an axial movement of the wheel 70 along the pivoting portion 30.

Because the present invention is selectively connected to the building block 60, the axial body 10 and the building block 60 could be separated to make the building block 60 become the general combining type when the moving function is not needed. For the reason, the versatility of the general building block is expanded without any limitation.

Figure 7:
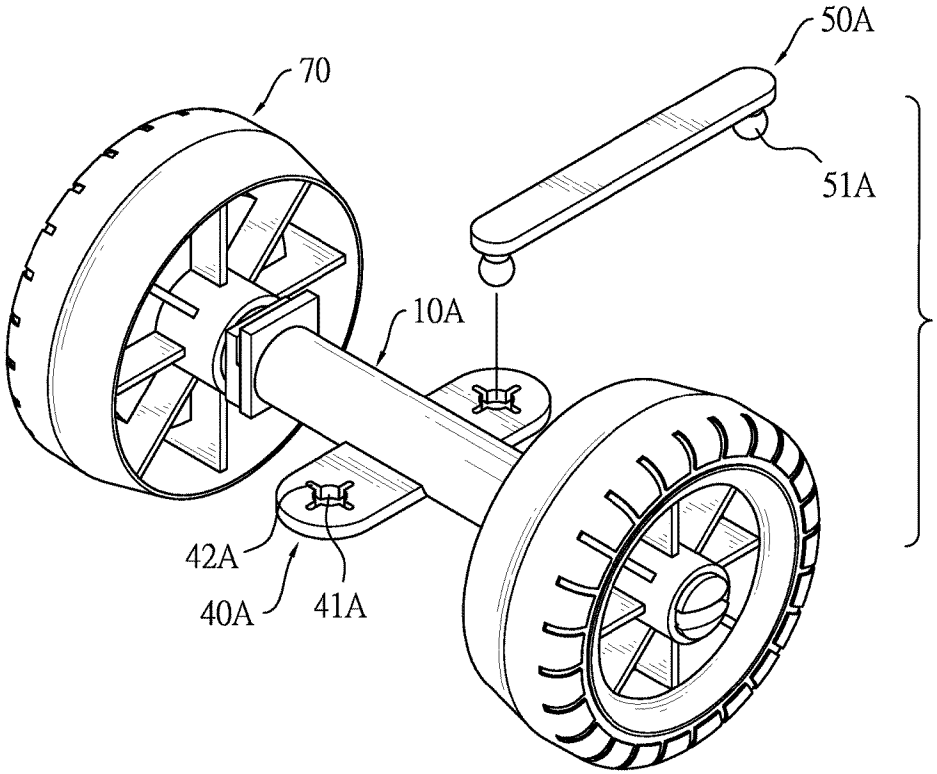
FIG. 7 is a perspective combining view of a second embodiment of the detachable axle and a connecting rod in FIG. 5.
Figure 8:
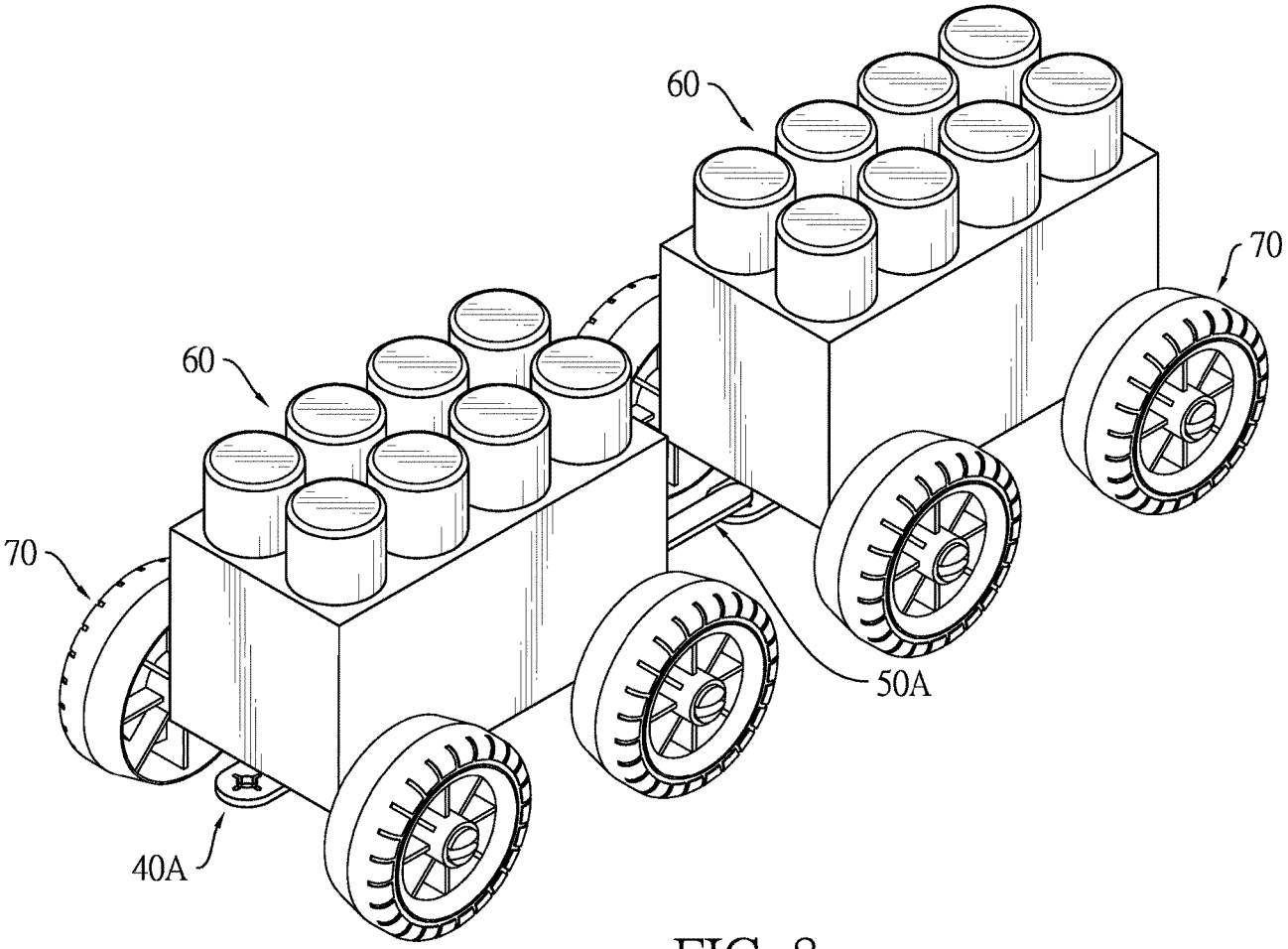
FIG. 8 is a perspective view of the detachable axle combined with the connecting rod and the building block in FIG. 7.
Figure 9:
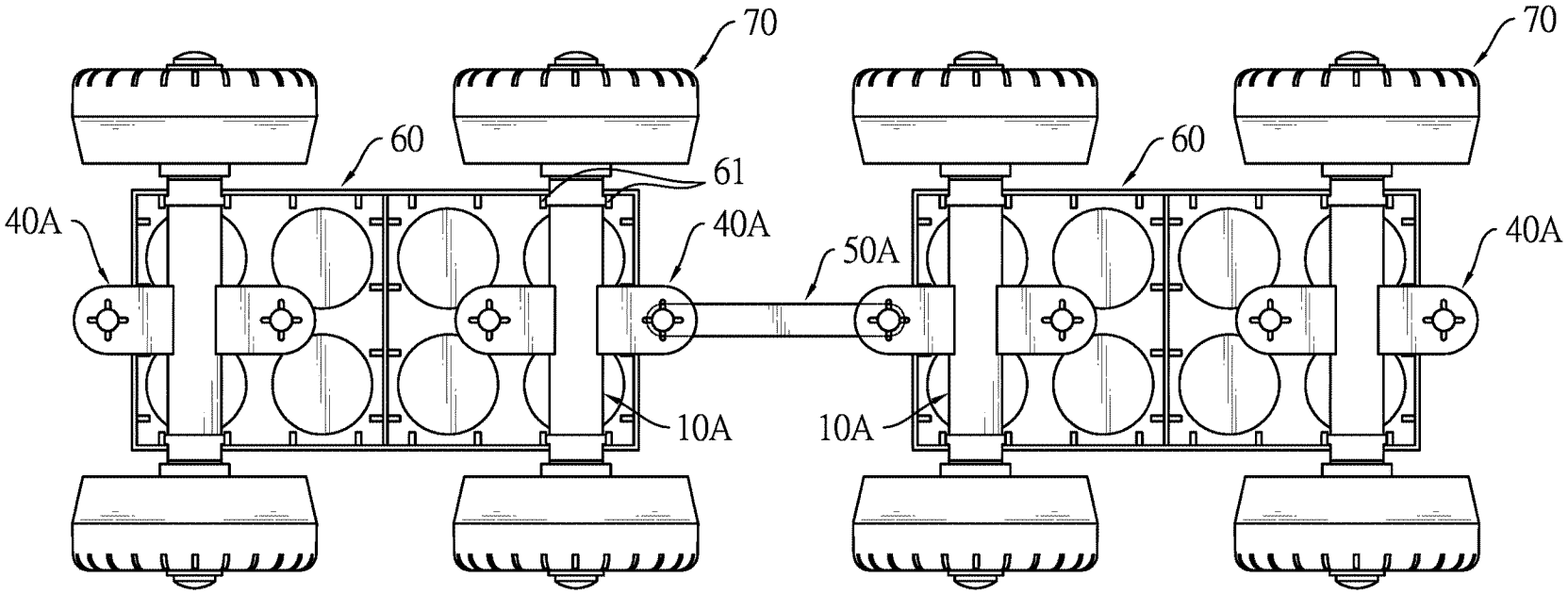
FIG. 9 is a bottom view of the detachable axle combined with the connecting rod and the building block in FIG. 7.

With reference to FIGS. 7 to 9, a second embodiment of a detachable axle in accordance with the present invention is substantially the same as the first embodiment. The difference is that the axial body 10A has two connecting plates 40A. The two connecting plates 40A are radially formed on the axial body 10A at a spaced interval. Each connecting plate 40A has an engaging hole 41A and multiple reserved holes 42A. The engaging hole 41A is formed through the connecting plate 40A. The multiple reserved holes 42A are formed through the connecting plate 40A and communicate with the engaging hole 41A. An area of each reserved hole 42A is smaller than an area of the engaging hole 41A.

With reference to FIGS. 7 to 9, two building blocks 60 are respectively combined with the detachable axle. One of the connecting plates 40A of each axial body 10A extends out of the connected building block 60. A connecting rod 50A is connected to the two building blocks 60. The connecting rod 50A has two engaging portions 51A, and the two engaging portions 51A are formed radially and respectively on two ends of the connecting rod 50A. The two engaging portions 51A of the connecting rod 50A are respectively engaged with the engaging hole 41A of a rear connecting plate 40A connected to a first building block 60 and the engaging hole 41A of a front connecting plate 40A connected to a second building block 60. So the two building blocks 60 could be towed by each other when traveling on the ground to expand the versatility of the building block 60.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A detachable axle comprising:
an axial body;
two engaging portions respectively formed on two axial ends of the axial body, each engaging portion having
an engaging groove radially formed on the engaging portion;
a first abutting plate connected to the axial body and radially extending outwards from the axial body;
a second abutting plate connected to the axial body and radially extending outwards from the axial body; wherein
the engaging groove of the engaging portion is radially formed between the first abutting plate and the second abutting plate; and
two pivoting portions respectively formed on the two engaging portions and axially extending outwards from the engaging portions, each pivoting portion being cylindrical.

2. The detachable axle as claimed in claim 1, wherein a radial extending length of the first abutting plate is longer than a radial extending length of the second abutting plate.

3. The detachable axle as claimed in claim 1, wherein
each one of the pivoting portions has
a compression groove axially formed on an end of the engaging portion; and
two limiting blocks respectively formed on two opposite outer surfaces of the pivoting portion.

4. The detachable axle as claimed in claim 2, wherein
each one of the pivoting portions has
a compression groove axially formed on an end of the engaging portion; and
two limiting blocks respectively formed on two opposite outer surfaces of the pivoting portion.

5. The detachable axle as claimed in claim 3, wherein each one of the pivoting portions has an obstructing block formed around the pivoting portion.

6. The detachable axle as claimed in claim 4, wherein each one of the pivoting portions has an obstructing block formed around the pivoting portion.

7. The detachable axle as claimed in claim 1, wherein the detachable axle further has at least one connecting plate radially formed on the axial body.

8. The detachable axle as claimed in claim 2, wherein the detachable axle further has at least one connecting plate radially formed on the axial body.

9. The detachable axle as claimed in claim 7, wherein each one of the at least one connecting plate has an engaging hole.

10. The detachable axle as claimed in claim 8, wherein each one of the at least one connecting plate has an engaging hole.

11. The detachable axle as claimed in claim 9, wherein
each one of the at least one connecting plate has
multiple reserved holes formed through the connecting plate and communicating with the engaging hole, and an area of each reserved hole being smaller than an area of the engaging hole.

12. The detachable axle as claimed in claim 10, wherein
each one of the at least one connecting plate has
multiple reserved holes formed through the connecting plate and communicating with the engaging hole, and an area of each reserved hole being smaller than an area of the engaging hole.

* * * * *